US005623767A

United States Patent [19]

Colavito

[11] Patent Number: 5,623,767

[45] Date of Patent: Apr. 29, 1997

[54] SIDING INSTALLATION ALIGNMENT TOOL

[76] Inventor: Christopher Colavito, 2881 Jack Rd., Clayton, N.C. 27520

[21] Appl. No.: 496,053

[22] Filed: Jun. 28, 1995

[51] Int. Cl.[6] ..... G01D 21/00

[52] U.S. Cl. ..... 33/647

[58] Field of Search ..... 33/646, 647, 648, 33/649, 411; 52/127.2, 546, 547, 548; 269/43, 95, 904

[56] References Cited

U.S. PATENT DOCUMENTS

| | | | |
|---|---|---|---|
| 368,574 | 8/1887 | Eby | 33/647 |
| 520,472 | 5/1894 | Abshier et al. | 33/646 |
| 4,159,029 | 6/1979 | Matthews | 33/647 |
| 4,164,346 | 8/1979 | Sickler | 33/647 |
| 4,314,429 | 2/1982 | Casteel et al. | 52/547 |
| 4,425,714 | 1/1984 | Kelly, Jr. | 33/646 |
| 4,473,100 | 9/1984 | Wheeler | 33/647 |
| 4,484,392 | 11/1984 | DeFino et al. | 33/647 |
| 5,370,377 | 12/1994 | Van Der Meer | 33/647 |

*Primary Examiner*—Thomas B. Will

[57] ABSTRACT

A siding installation tool for the installation of horizontally overlapping siding boards on the exterior of a building structure. The tool includes a J-shaped hook that is integrally formed to an elongated body member at a terminal end thereof for attachment to an upper edge of a siding board that has been previously installed on the building. The tool includes an inverted L-shaped handle that is pivotally attached by a connecting rod that can be inserted through one of several adjustment apertures in the body member to provide predetermined amounts of overlap of the siding boards. To enable removal of the tool from between two siding boards after aligning them, the L-shaped handle is pivoted 180 degrees about an offset axis creating a clearance gap between the body of the L-shaped handle and a lower edge of the siding board being installed. This gap permits the tool to be pushed upwardly so that the end of the J-hook clears the upper edge of the siding board whereon the tool has been positioned. The overlapping siding board can be flexed outwardly at a bottom edge by advantageous use of the handle so that the tool can be extracted from between the siding boards. The L-shaped handle is provided with a frictional locking mechanism to prevent unwanted rotation of the handle during the installation procedure.

7 Claims, 3 Drawing Sheets

SIDING INSTALLATION ALIGNMENT TOOL

FIELD OF INVENTION

This invention relates to tools used in the installation of overlapping siding boards on the exterior of buildings, and more particularly, to a tool that may be conveniently removed from the building after installation is completed.

BACKGROUND OF INVENTION

It is difficult for one person to install horizontally overlapping siding boards because each siding board must be precisely horizontal and uniformly placed with respect to each adjacent siding board.

As a result a substantial number of tools and gauges have been invented to permit one person to install siding. Typically, these tools are secured to installed lengths of siding and function to support a second, overlapping siding board to be installed in a predetermined position.

However, many of the siding installation tools of the prior art are relatively complex in construction and are not readily releasable from the siding boards after installation. The present invention provides a tool that is relatively simple in construction and can be utilized for the convenient installation of overlapping siding boards.

Concise Explanation of Prior Art

U.S. Pat. No. 1,598,986 to Clifford Ping discloses a spacing tool for use in applying weather boarding and shingles so that they may be overlapped at the proper distance.

U.S. Pat. No. 368,574 to Christie Eby discloses an adjustable supporting bracket for weather boards which functions to hold the weather board to be installed in the desired overlapping position.

U.S. Pat. No. 4,314,429 to Ernest Castell, et al., discloses a siding holder device for supporting one end of a laps siding while an opposite end is being nailed during a siding installation procedure.

U.S. Pat. No. 4,473,100 to Wallace T. Wheeler discloses a weather board clamping device for aiding a carpenter in applying weather boards to a building.

U.S. Pat. No. 4,484,392 to Armond A. DeFino, et al., discloses a method means of installing siding including a tool that is adapted to hook on the upper edge of an installed length of siding. However, this tool has a handle that has limited rotational movement capability and cannot be adjusted relative to the hook member in the manner of the present invention.

U.S. Pat. No. 4,425,714 to Jams B. Kelly, Jr. discloses a tool for assisting in the installation of horizontally overlapping siding boards for the exterior of a building including a body member and a gate member rotatably attached thereto. However, this tool lacks the adjustment capability and the locking mechanism of the present invention.

Finally, U.S. Pat. No. 5,370,377 to Johannes Van Der Meer discloses a siding tool which when used in multiples facilitates the installation by a single workman of long lengths of plank material commonly used as cladding for buildings.

BRIEF DESCRIPTION OF INVENTION

After much research and study into the above mentioned problems, the present invention has been developed to provide an improved siding installation tool that is used when a carpenter is installing horizontally overlapping pieces of siding on the exterior of a building. The carpenter uses the tool to ensure that each successive siding board overlaps the board below it by an equal amount at each end.

The above is accomplished by the use of a device including an inverted-L-shaped handle with an upwardly extending alignment means integrally formed thereto. A downwardly facing J-shaped hook is attached to the body of the L-shaped handle by a connecting rod or bolt that can be inserted through one of several adjustment apertures in the body of the hook member to provide for varying amounts of overlap of the siding boards. A support rod fixedly attached to the handle and extending upwardly therefrom keeps the top board from falling off the tool until the carpenter can tack it into the wall.

To enable removal of the tool from between two siding boards after aligning them, the tool's handle is pivoted 180 degrees on the connecting rod in either direction so that the handle is rotated upwardly. The connecting rod is offset towards the handle end of the body of the tool so that when the handle is pivoted 180 degrees, there is a clearance gap between the body of the handle and the bottom edge of the top siding board. This gap is at least as long as the end hook portion of the J-hook. Thus, the tool can be pushed upwardly so that the end of the hook member clears the top edge of the bottom board where it has been positioned. The top board can then be flexed outwardly at its bottom edge so that the tool can be extracted from between the boards.

The tool of the present invention includes a locking mechanism to prevent the handle from rotating when siding boards are slid across the top of the tool as they are being positioned for installation thereby maintaining the board in the desired overlapping position.

In view of the above, it is an object of the present invention to provide a siding installation tool that is relatively simplistic in construction and yet can be utilized for the convenient and accurate installation of siding boards.

Another object of the present invention is to provide a siding tool that serves as a support for holding a siding board at a desired overlapping position with respect to an underlying siding board during the installation process.

Another object of the present invention is to provide a siding installation tool which is used in pairs to hold a siding board that is to be installed on a building in a desired overlapping relation to an adjacent board to ensure unified degree of overlapping between all the boards.

Another object of the present invention is to provide a siding installation tool including a rotating handle that features a spring-loaded locking device that engages a corresponding indentation in the depending hook member to prevent unwanted pivoting of the handle during the installation process.

Other objects and advantages of the present invention will become apparent and obvious from a study of the following description and the accompanying drawings which are merely illustrative of such invention.

DETAILED DESCRIPTION OF INVENTION

Figure 1:
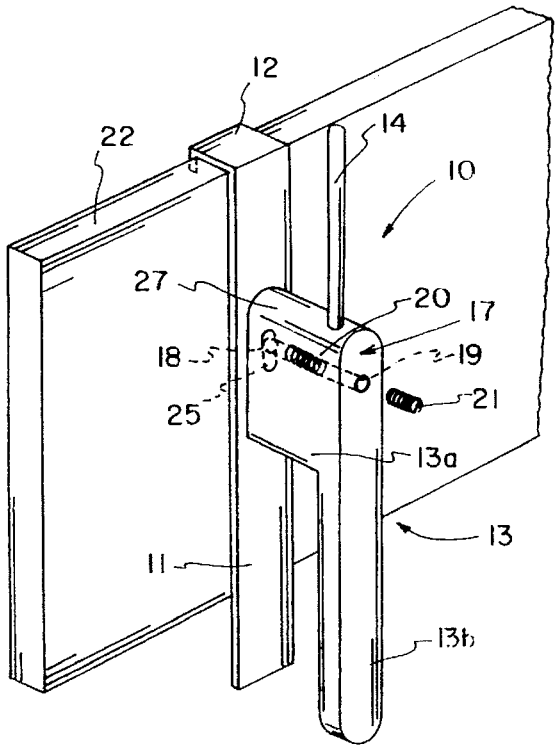
FIG. 1 is a front perspective view of a preferred embodiment of the siding installation tool of the present invention showing the locking mechanism in exploded view.

With further reference to the drawings, a preferred embodiment of the siding installation tool in accordance with the present invention, indicated generally at 10, is shown in FIG. 1, depending from a siding board 22.

Tool 10 includes an elongated body member 11 having a J-shaped hook 12 integrally formed thereto at one end.

Tool 10 further includes an inverted-L-shaped handle, indicated generally at 13, having a short leg 13*a* and a long leg 13*b*. Short leg 13*a* includes an alignment cam 27 integrally formed thereon at an upper surface thereof at a predetermined vertical distance from J-shaped hook 12.

L-shaped handle 13 includes an elongated support rod 14 that is disposed in generally axial alignment with long leg 13*b* extending upwardly therefrom as shown in FIG. 1.

Figure 2:
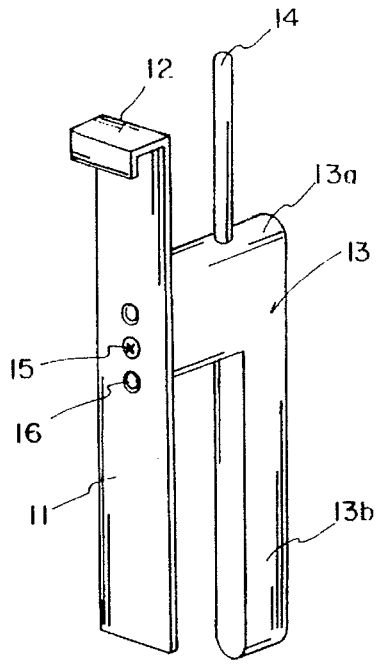
FIG. 2 is a rear perspective view of the present invention showing the adjustable handle in relation to the hook member.

Turning now to FIG. 2, L-shaped handle 13 is pivotally attached to body member 11 by a connecting rod or threaded bolt 15 which is inserted through a preselected adjustment aperture 16 in body member 11 and threadably secured to L-shaped handle 13. Adjustment apertures 16 are arranged linearly at regular intervals on a center line of body member 11 at the approximate mid point thereof. Adjustment apertures 16 are sized to a slip-fit condition with threaded bolt 15 such that L-shaped handle 13 is imparted with 360 degree rotational movement about a center axis of bolt 15 in a plane that is parallel to the exterior surface of siding board 22. Apertures 16 are arranged at periodic intervals to provide for selective adjustment of the vertical distance between alignment cam 27 and J-shaped hook 12 for use with siding boards of varying width.

Referring again to FIG. 1 it will be appreciated that tool 10 includes a locking mechanism, indicated generally at 17, which provides frictional resistance to prevent unwanted rotation of L-shaped handle 13 about the center axis of threaded bolt 15 during a siding installation procedure described in detail hereinafter.

In the embodiment shown in FIG. 1, locking mechanism 17 includes a spring-loaded ball bearing 18 that is disposed in spring-locating hole 19 drilled through short leg 13*a* of L-shaped handle 13. Ball bearing 18 is spring-biased to a positive contact with groove 25, which is formed in the surface of body member 11, by compression spring 20 which is retained in hole 19 by means of set screw 21.

It will be appreciated that set screw 21 may be threadably advanced into corresponding threads formed in hole 19 to compress spring 20 to increase frictional resistance of locking mechanism 17 in order to prevent unwanted pivoting of handle 13 during a siding installation procedure.

Figure 3:
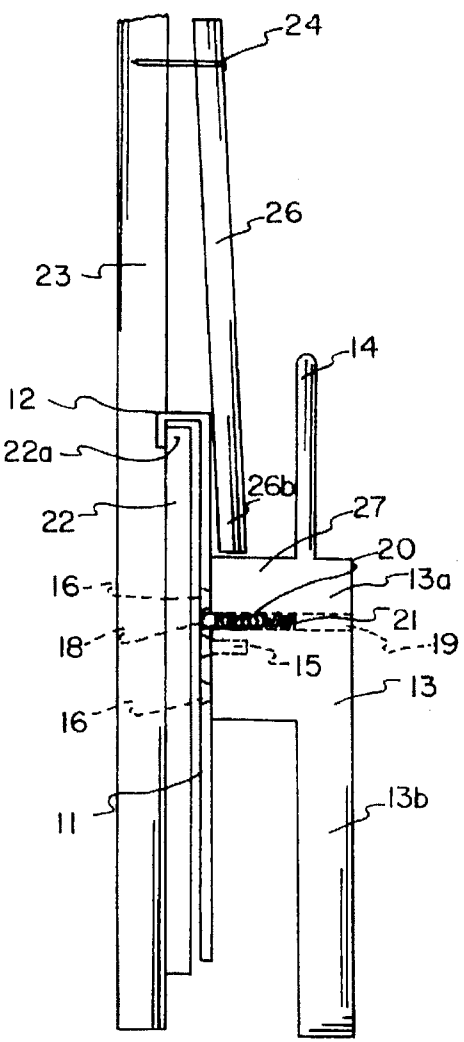
FIG. 3 is a side elevational view of the tool in a siding engagement position.

Turning now to FIG. 3 there is shown therein a side view of tool 10 in a siding engagement position for installing siding board 22 on the exterior of a building 23.

In a siding installation procedure utilizing the present invention, tool 10 is first engaged on the upper edge 22*a* of siding board 22 by the J-shaped hook 12 of body member 11. It can be seen that in this position long leg 13*b* of L-shaped handle 13 is disposed downwardly in substantial alignment with body member 11. Support rod 14 is extended upwardly and assists in supporting siding board 26 in the desired position for installation.

It will be appreciated that the above position the lower edge 26*b* of siding board 26 is supported in position by alignment cam 27 integrally formed in a top surface of short leg 13*a* of L-shaped handle 13 in the desired overlapping relation to the next adjacent lower siding board 22.

It can be seen that alignment cam 27 is generally semi-circular in cross-section to facilitate the rotational movement of handle 13 as more clearly shown in FIG. 1.

Still referring to FIG. 3, it will be appreciated that the overlapping relation between adjacent siding boards 22 and 26 may be selectively adjusted by positioning threaded bolt 15 in alternate adjustment apertures 16 which are arranged linearly at regular intervals on a center line of body member 11. In this manner the vertical distance between alignment cam 27 and J-shaped hook 12 may be varied incrementally to obtain the desired overlapping relation of siding boards 22 and 26.

Next, siding board 26 is tacked to the exterior surface of building 23 with sufficient nails 24 to hold siding board 26 in position while tool 10 is removed from between siding boards 22 and 26.

One of the principal advantages of the present invention is that tool 10 can now be easily removed from contact with siding boards 22 and 26 without damaging the same.

Figure 4:
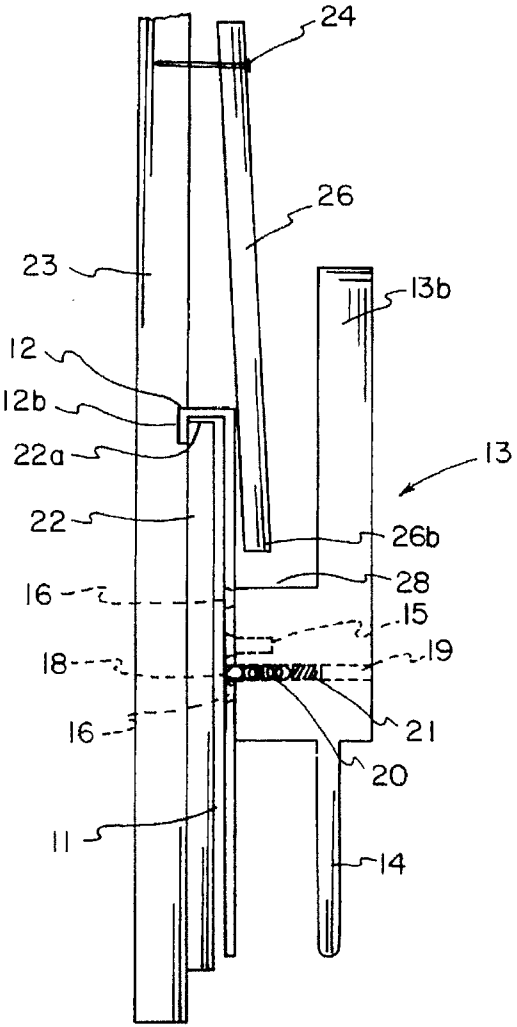
FIG. 4 is a side elevational view of the tool in a siding disengagement position 180 degrees from the position shown in FIG. 3.

To enable removable of tool 10 from between adjacent siding boards 22 and 26 after aligning them, L-shaped handle 13 is pivoted 180 degrees about a center axis of threaded bolt 15 such that long leg 13*b* of L-shaped handle points upwardly as shown in FIG. 4.

It can be seen in FIG. 4 that a center axis of threaded bolt 15 is offset from a center line of short leg 13*a* toward the long leg 13*b* portion of L-shaped handle 13 such that when handle 13 is pivoted 180 degrees, there is a clearance gap as at 28 between a lower edge 26*b* of top siding board 26 and short leg 13*a* of handle 13. Gap 28 is a predetermined distance that is at least as long as the terminal end 12*b* of J-hook 12.

Figure 5:
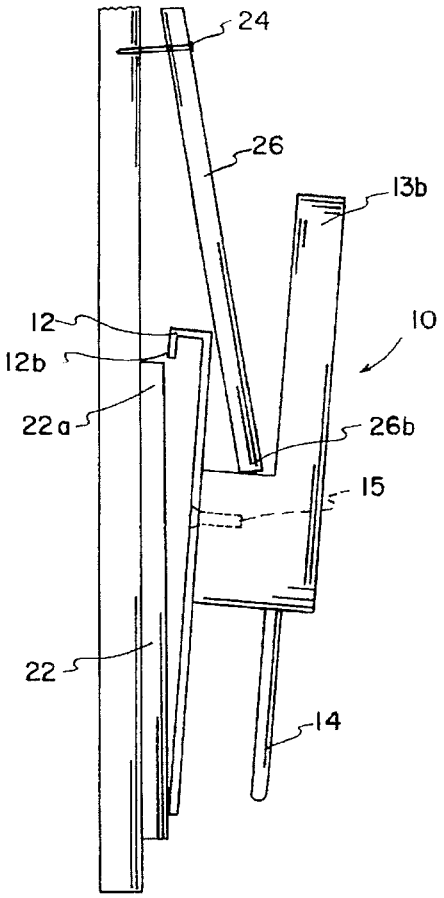
FIG. 5 is a side elevational view of the tool being extracted from between siding boards.

Referring now to FIG. 5, tool 10 can be pushed upwardly so that the terminal end 12*b* of J-hook 12 may be disengaged from an upper edge 22*a* of siding board 22 so that J-hook 12 clears the upper edge 22*a* for removal. In this position long leg 13*b* of handle 13 may be used advantageously to flex siding board 26 outwardly at its lower edge 26*b* to facilitate extraction of tool 10 from between the siding boards 22 and 26.

Thereafter, siding board 26 is secured to the exterior surface of building 23 with sufficient nails 24 to complete the installation.

In a preferred method for installing siding boards utilizing the present invention, a plurality of tools 10 are positioned at selected intervals along the length of siding board 22 to retain the same in the desired overlapping relation to the next adjacent siding board 26. In this manner a single carpenter may readily and accurately position a long length of siding board 26 on the exterior of a building prior to attaching the same in a finished position.

Further, the 360 degree rotational movement of L-shaped handle 13 in either direction facilitates the removal of tool 10 from virtually any physical position which may be encountered by the carpenter in the work place. For example, tool 10 may be removed from siding boards 22 and 26 in an overhead position wherein a carpenter is standing on a scaffold or from an extended side-reaching position wherein the carpenter is on a ladder. Thus the present invention provides a versatile and easy-to-use tool having obvious economic advantages over the devices of the prior art.

Figure 6:
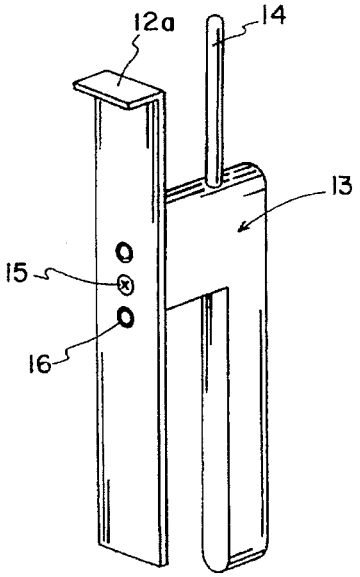
FIG. 6 is a perspective view of an alternative embodiment of the tool of the present invention showing a modified hook portion that is configured as an inverted L-shape in cross-section.

Referring now to FIG. 6, there is shown an alternative embodiment of tool 10 including a modified hook portion 12*a* that is configured as an inverted L-shape in cross-section. This alternative embodiment of tool 10 is adapted for use with larger panels of prefabricated siding and exterior coverings which are not suitable for use with tool 10 having the J-shaped hook 12 described hereinabove.

From the above it can be seen that the present invention provides a siding installation tool of relatively simple construction that enables accurate alignment and efficient installation of overlapping siding.

Further, the siding installation tool includes a handle having 360 degree rotational movement in either direction to enable easy removal of the tool from between adjacent siding boards after positioning the same.

The terms "upper", "lower", "side", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. A tool for use in the alignment and installation of horizontally overlapping siding boards on the exterior of a building, said boards having an upper edge and a lower edge, said tool comprising:

an elongated body member having a downwardly facing, J-shaped hook integrally formed at a terminal end thereof for engaging said upper edge of a first siding board enabling said tool to depend from said upper edge;

an inverted L-shaped handle having a short leg portion and a long leg portion, said handle being pivotally attached to said body member at said short leg portion by connecting means, said connecting means imparting a 360 degree rotational movement to said handle in a plane generally parallel to an exterior surface of said first siding board between a siding engagement position and a siding disengagement position, said handle including an upwardly facing alignment means for engaging said lower edge of a second siding board to be installed on said building in overlapping relation to said first siding board such that when said tool is in a depending relation to said first siding board, said lower edge of said second siding board is held on said alignment means in an overlapping relation to said first siding board during installation of said second siding board on said building and is thereafter removable from said depending relationship with said first siding board by rotation of said handle 180 degrees in either direction to said disengagement position.

2. The tool of claim 1 wherein a locking means including a spring-loaded ball bearing mechanism is disposed intermediate said body member and said handle, said locking means being spring-biased to a locked position when said handle is in said siding engagement position whereby unwanted rotation of said handle during the installation of said siding boards is prevented.

3. The tool of claim 2 wherein said body member is provided with a plurality of adjustment apertures disposed linearly at regular intervals on a center line thereof to provide for alternate placement of said connecting means whereby said alignment means may be selectively adjusted to enable predetermined, overlapping relationships between said siding boards.

4. The tool of claim 3 wherein said handle is provided with a support rod fixedly attached thereto and extending upwardly therefrom when said tool is in said siding engagement position, said support rod functioning to retain said second siding board on said alignment means until attachment of said second siding board on said building is completed.

5. The tool of claim 4 wherein said alignment means comprises an alignment cam integrally formed on a top surface of said short leg portion, said cam being generally semi-circular in cross-section to facilitate rotational movement about a center axis of said connecting means.

6. The tool of claim 5 wherein said tool includes an inverted L-shaped hook substituted for said J-shaped hook.

7. A method of installing horizontally, overlapping siding boards on the exterior of a building, said boards having an upper edge and a lower edge, utilizing a tool having an elongated body member including a downwardly facing J-shaped hook integrally formed at a terminal end thereof for engaging said upper edge of a first siding board installed on said building, said tool further including an inverted L-shaped handle being pivotally attached to said body member by connecting means, said connecting means imparting 360 degree rotational movement of said handle in a plane generally parallel to an exterior surface of said first siding board between a siding engagement position and a siding disengagement position, said handle including an upwardly facing alignment means for engaging said lower edge of a second siding board to be installed on said building in overlapping relation to said first siding board during installation of said second board on said building, said tool being removable from said overlapping relationship with said first siding board by rotational movement of said handle to said disengagement position, said tool including locking means disposed intermediate said body member and said handle, said locking means being spring-biased to a locked position when said handle is in a siding engagement position, said method comprising:

adjusting said tool to set said alignment means to a preselected overlapping relationship for said siding boards;

installing a first siding board at the desired vertical elevation on the exterior of said building;

engaging said downwardly facing J-shaped hook portion of said tool with said upper edge of said first siding board whereby said tool depends from said upper edge;

rotating said L-shaped handle to a siding engagement position;

locking said L-shaped handle in said siding engagement position;

aligning a second siding board to be installed on said building in overlapping relation to said first siding board such that said lower edge of said second siding board is supported on said alignment means;

tacking said second siding board to the exterior surface of said building with sufficient nails to hold said siding board in position while said tool is removed;

rotating said handle 180 degrees in either direction to a siding disengagement position whereby said lower edge of said second siding board is released from contact with said alignment means providing a clearance gap for removal of said tool;

pushing upwardly on said handle to disengage said J-shaped hook from said upper edge of said first siding board;

flexing said lower edge of said second siding board outwardly from the exterior surface of said building;

removing said tool from between said siding boards; and nailing said second siding board to the exterior of said building where it is to be permanently retained.

* * * * *